US005240112A

United States Patent [19]

Newburger

[11] Patent Number: 5,240,112

[45] Date of Patent: Aug. 31, 1993

[54] EVACUATABLE OR INFLATABLE PLASTIC BAG

[76] Inventor: Bronson E. Newburger, 1222 Third St., New Orleans, La. 70130

[21] Appl. No.: 841,019

[22] Filed: Feb. 25, 1992

[51] Int. Cl.[5] ..... B65D 81/20

[52] U.S. Cl. ..... 206/524.8; 383/3; 383/41; 383/63

[58] Field of Search ..... 206/524.8, 522; 383/3, 383/41, 63, 100, 906, 904; 251/4, 7, 342

[56] References Cited

U.S. PATENT DOCUMENTS

| | | | |
|---|---|---|---|
| 274,447 | 3/1883 | Kennish | 251/342 |
| 2,279,834 | 4/1942 | McGee | 251/342 |
| 2,913,030 | 11/1959 | Fisher | 206/524.8 X |
| 3,160,323 | 12/1964 | Weisberg | 206/277 X |
| 3,762,404 | 10/1973 | Sakita | 206/524.8 |
| 3,777,498 | 12/1973 | Andrews et al. | 383/3 |
| 3,796,245 | 3/1974 | Wildensteiner | 251/342 |
| 3,980,226 | 9/1976 | Franz | 53/434 X |
| 4,705,085 | 11/1987 | Brown | 383/3 X |
| 4,730,635 | 3/1988 | Linden | 251/342 |
| 4,841,603 | 6/1989 | Ragni | 383/3 |
| 4,863,093 | 9/1989 | DuCorday | 229/117.15 |
| 4,877,334 | 10/1989 | Cope | 383/3 |
| 4,903,718 | 2/1990 | Sullivan | 383/41 |
| 4,972,825 | 11/1990 | Vescovo, Jr. | 383/103 |
| 5,142,970 | 9/1992 | Erkenbrack | 383/100 |

FOREIGN PATENT DOCUMENTS

| | | | |
|---|---|---|---|
| 1112446 | 8/1961 | Fed. Rep. of Germany | 383/63 |
| 2824397 | 12/1978 | Fed. Rep. of Germany | 383/3 |
| 0029750 | 2/1991 | Japan | 206/524.8 |

*Primary Examiner*—Allan N. Shoap
*Assistant Examiner*—Christopher McDonald
*Attorney, Agent, or Firm*—Dalton L. Truluck

[57] ABSTRACT

A thin flexible plastic bag having a permanently closed end and an open end with a main zipper closure formed of mateable male and female interlockable portions extending across the entire open end. The bag is provided with a stem and pinch valve construction with which the bag can be orally evacuated for sealing its contents in a vacuum-tight condition or with which the bag can be orally inflated and then used as a packing around breakables.

9 Claims, 2 Drawing Sheets

EVACUATABLE OR INFLATABLE PLASTIC BAG

FIELD OF THE INVENTION

This invention relates in general to a thin flexible plastic bag which can be evacuated or inflated, whichever is desired, and in particular to an improved stem and pinch valve construction for the bag by means of which the bag can be quickly evacuated for sealing items placed therein or by means of which the bag can be easily inflated for use as a packing around breakables.

DISCUSSION OF THE PRIOR ART

Flexible plastic bags which are capable of being evacuated are known in the prior art and are exemplified by U.S. Pat. No. 2,913,030 to Fisher and U.S. Pat. No. 3,980,226 to Franz. Also, flexible plastic bags capable of inflation are known and are exemplified by U.S. Pat. No. 4,705,085 to Brown and U.S. Pat. No. 4,877,334 to Cope. However, in all of the known evacuatable or inflatable plastic bags, the stem and valve arrangement provided for evacuating or inflating the bags lacks simplicity in construction, requires two hands to manipulate, or is difficult to assemble with the bag. For example, the stem and valve arrangement shown in Fisher lacks simplicity in that it consists of two parts which must be separately molded and then assembled together, thus rendering it expensive to manufacture. Also, the stem and valve arrangement of Fisher must be attached to the bag by a heat-sealing operation, which requires a specialized tool. In addition, although the valve of Fisher is capable of being employed to inflate the bag as well as to evacuate the bag, its construction is such that it would be unreliable for maintaining the bag inflated because the increased internal air pressure when the bag is inflated would force the valve to its open position, especially if the bag were to be squeezed, causing the air to flow from the bag and thereby deflate it.

Similarly, the stem and valve arrangements illustrated by Franz in FIGS. 4 and 6 thereof require two hands to manipulate, and the FIG. 6 arrangement involves parts which must be separately molded. Also, the open end of the bag disclosed by Franz requires a separate tie member to close it.

The bags of Brown and Cope are only capable of inflation and cannot be employed to seal articles in a substantially air-free environment, as in the present invention.

Attention is further directed to U.S. Pat. Nos. 3,160,323 to Weisberg and 3,796,245 to Wildensteiner. These patents disclose closures formed by interlocking male and female parts which bear some resemblance to the valve construction of the present invention but which are employed for entirely different purposes and, in the case of Wildensteiner, functions and operates differently and requires a more complex molding operation than the valve of the present invention.

SUMMARY OF THE INVENTION

It is an object of the invention to provide a simple and efficient means for consumers to package articles in a thin flexible plastic bag which can be orally evacuated in a simple and efficient manner to cause the bag to collapse about an article and conform substantially to its shape The bag has particular utility in packaging food products which it is desired to maintain fresh for long periods of time, but is applicable also to any item which one wishes to keep moisture and dust free.

Another object of the invention is to provide a thin flexible plastic bag which alternatively can be orally inflated, as well as evacuated, and thus can be utilized as a packing around breakables.

Briefly, the plastic bag of this invention is formed of any suitable conventional thin flexible plastic material and is provided with a stem and pinch valve arrangement by means of which the bag can be either orally evacuated or inflated and subsequently closed to maintain the bag in the evacuated or inflated state. In one version the stem and pinch valve arrangement is formed unitarily in one piece with the bag. In another version the stem and pinch valve arrangement is formed separately from the bag and is later affixed to the bag, usually just prior to use of the bag, although it may be attached at any time.

Except for the addition of the stem and pinch valve arrangement, the bag itself is otherwise substantially identical to zippered storage bags or freezer bags commonly available in the marketplace. That is, the bag itself is formed of thin flexible plastic material with one end permanently closed and the other end provided with a zipper closure formed by mateable male and female interlockable portions extending across the entire open end. By aligning the male and female portions and pressing them together the bag is closed. The pinch valve is also constructed of mating male and female interlockable portions of the same type as those formed across the open end of the bag. After the mateable male and female closure portions at the end of the bag are closed, the bag either can be orally evacuated by suction through the stem or inflated by blowing through the stem, and then the stem can be quickly closed by simply pinching the male and female valve portions together with one hand to thereby maintain the bag in its evacuated or inflated state.

In the version employing the separately formed stem and pinch valve arrangement, preferably one end of the stem is provided with a pointed tip for puncturing the bag to insert the stem through the bag, and the other end is provided with a peripheral flange carrying an adhesive for securing the stem to the internal surface of the bag.

Further features, advantages, and attributes of the invention will be more fully realized and understood from the following detailed description taken in conjunction with the accompanying drawings.

DETAILED DESCRIPTION OF THE INVENTION

Figure 1:
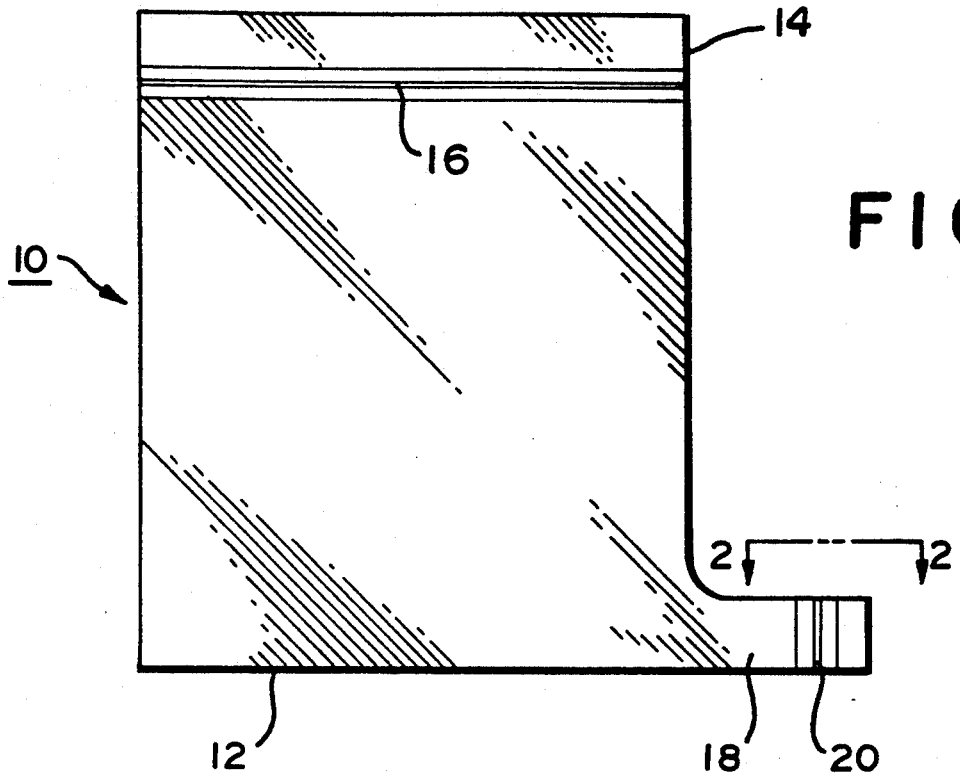
FIG. 1 is a plan view of a flexible plastic bag provided with a unitary stem and pinch valve construction in accordance with a first embodiment of the invention.
Figure 2:
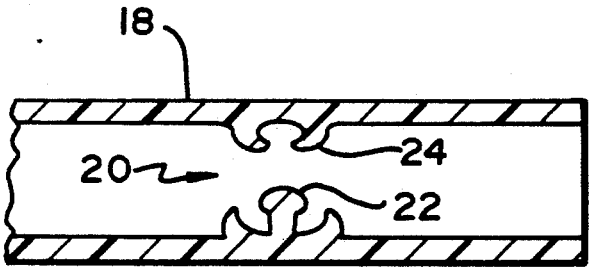
FIG. 2 is an enlarged sectional view, taken in the direction of line 2—2 of FIG. 1, of a portion of the stem and pinch valve, and showing the pinch valve in its open position.
Figure 3:
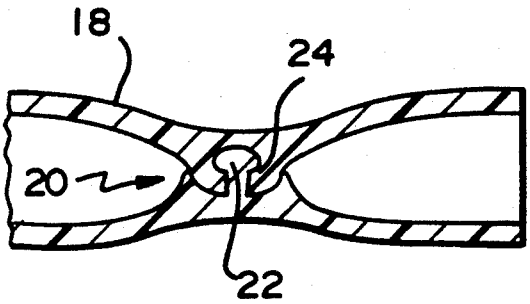
FIG. 3 is an enlarged sectional view similar to that of FIG. 2 but showing the pinch valve in its closed position.
Figure 4:
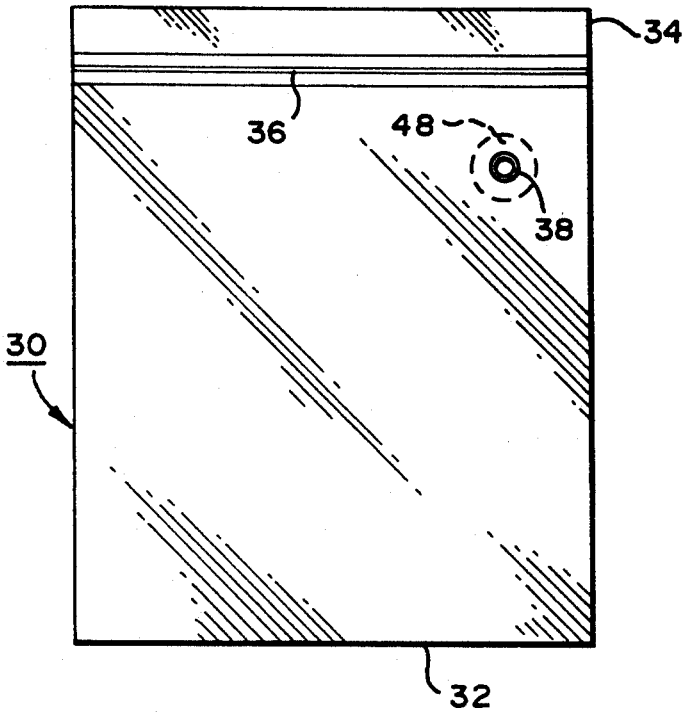
FIG. 4 is a plan view of a flexible plastic bag provided with a separately attached stem and pinch valve construction in accordance with a second embodiment of the invention.

Referring first to the embodiment of the invention shown in FIG. 1 wherein the flexible bag has the stem and pinch valve construction formed unitarily therewith, the numeral 10 designates the thin flexible plastic bag as a whole. The bag 10 has a permanently closed end 12 and an open end 14. Extending across the entire open end 14 is a main zipper closure 16 formed of mateable male and female interlockable portions of a construction substantially identical to those provided on zippered storage bags or freezer bags commonly available in the marketplace. The construction and operation of such zipper closures is well known and therefore no further discussion thereof is deemed necessary. Protruding outwardly from a side of the bag at the closed end or bottom thereof is the unitarily formed tubular stem 18 and pinch valve 20 arrangement of the invention. The tubular stem and pinch valve are formed of the same material as the bag, which material may be any suitable conventional thin flexible plastic. As can be seen from the enlarged views of FIGS. 2 and 3, the pinch valve 20 is formed of mateable male and female interlockable portions 22 and 24, respectively. These male and female portions are similar to the male and female portions which make up the zipper closure 16 at the open end 14 of bag 10, and each extends one half the inner circumference of the tubular stem 18. More specifically, the female portion 24 comprises a C-shaped open channel having continuous imperforate sidewalls extending the full length thereof; and the male portion 22 comprises a continuous rib having an enlarged head complementary in shape to the C-shaped channel for mating therewith. When the male and female portions of pinch valve 20 are together, they interlock as shown in FIG. 3 and close the pinch valve.

The bag 10 of FIG. 1 may be evacuated or inflated by utilizing the tubular stem and pinch valve arrangement. More specifically, when it is desired to employ the bag as a package for containing an article, the end 14 is opened, an article is placed therein, the end 14 is then closed by pressing together the zipper closure 16, the bag is next evacuated by oral suction using the tubular stem 18, and then the pinch valve 20 is pinched closed to maintain the bag in its evacuated and collapsed state about the article. When the bag is to be employed as a packing around breakables, end 14 is closed by pressing together the zipper closure 16, the bag then is inflated by blowing through tubular stem 18, and finally the pinch valve 20 is pinched closed to maintain the bag in inflated condition for positioning around breakables.

It is evident from the above explanation that the invention provides a very simple and efficient manner of attaining a bag which can be easily evacuated or inflated and then quickly sealed by a pinch valve which requires only one hand to pinch it to its closed position. Of course, the pinch valve may be reopened easily as well, thus permitting the bag to be reused.

The tubular stem containing the pinch valve has been illustrated and described in the foregoing embodiment as being located at the closed end or bottom of the bag, but it is to be understood that it may be positioned anywhere on the bag.

Figure 5:
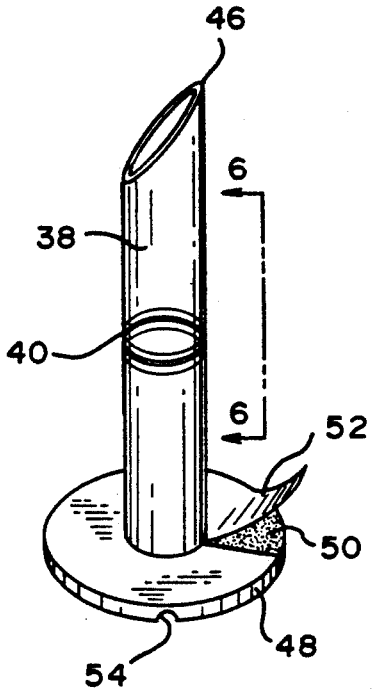
FIG. 5 is an enlarged detail view of the stem and pinch valve construction of the embodiment shown in FIG. 4.
Figure 6:
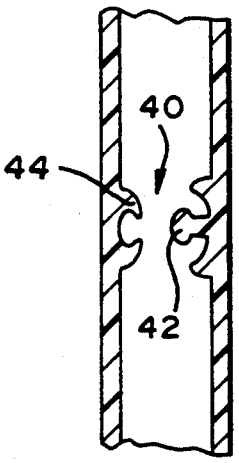
FIG. 6 is a sectional view, taken in the direction of the line 6—6 of FIG. 5, of a portion of the stem and pinch valve, and showing the pinch valve in its open position.
Figure 7:
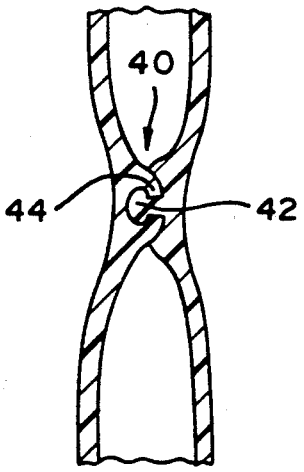
FIG. 7 is a sectional view similar to that of FIG. 6 but showing the pinch valve in its closed position.

Reference is now made to FIGS. 4–7, which depict the second embodiment of the invention. In this version the bag 30 is a thin flexible zippered plastic bag substantially identical to bags that are commercially available in many stores. Such bag has a permanently closed end 32, an open end 34, and a main zipper closure 36 composed of mateable male and female interlockable portions extending across the entire open end 34. In order to render the bag 30 capable of being readily evacuated or inflated, an attachable stem and pinch valve construction is provided. As best seen in FIG. 5, the stem and pinch valve construction comprises an elongated tubular stem 38 containing a pinch valve 40. The stem 38 is formed of a stiff but yieldable plastic material and preferably has at one end a pointed tip 46 produced by cutting the tube at a slant or by molding it in the shape illustrated. The other end of the stem 38 has a peripheral flange 48 the upper surface of which carries a pressure-sensitive adhesive 50 protected until ready to use by a strip 52 of wax paper or other peel-away covering material. Extending across the lower surface of the peripheral flange 48 is a gully or groove 54 which communicates with the interior of the tubular stem 38 for allowing air to escape when the bag or article within the bag is in contact with the remainder of the lower surface of the flange. Approximately midway of the stem is a pinch valve 40 formed by mating male and female portions 42 and 44, respectively. As with the embodiment of FIGS. 1–3, these male and female portions 42 and 44 are similar to the male and female portions which constitute the main zipper closure 36 at the open end of bag 30, and each extends one half the inner circumference of the tubular stem 38. By simply pressing the male and female portions 42 and 44 together with the fingers of one hand, the pinch valve 40 goes from the open condition shown in FIG. 6 to the closed condition depicted in FIG. 7.

Installation of the stem and pinch valve unit to the bag 30 is a very simple procedure. Specifically, the bag is first opened at end 34, next the protective covering 52 is removed to expose the adhesive 50, then the stem and pinch valve unit is inserted into the bag, then by utilizing the pointed tip 46 a hole is pierced in the bag, and finally the tubular stem 38 is forced through the hole until the adhesive 50 comes into contact with the internal surface of the bag and is pressed into tight engagement therewith. In the procedure just outlined, it is manifest that the bag 30 need not be opened before the protective covering 52 is removed but could be opened subsequent to removal of the covering 52. Alternatively, the covering 52 could be removed after the stem and pinch valve unit is inserted into the bag. In other words, the sequence of steps involved in the installation of the stem and pinch valve unit is capable of obvious variation.

Once the stem and pinch valve unit has been properly installed, the bag is ready for use. To seal an article in a substantially vacuum-tight manner within the bag, the article is placed into the bag, then the main zipper closure 36 is closed, next air is exhausted from the bag by oral suction through the tubular stem 38, and finally the pinch valve 40 is pinched closed. To inflate the bag so that it can be used as a packing around breakables, the main zipper closure 36 is first closed, then air is blown into the bag through the tubular stem 38, and lastly the pinch valve 40 is pinched closed.

In the embodiment just described with relation to FIGS. 4–7, the stem has been disclosed as being of one-piece construction and the adhesive utilized has been set forth as being a pressure-sensitive variety. These are the preferred structures, but the invention in its broadest aspect is not limited to those exact structures. There are other ways to attach the stem and valve unit to the bag. For example, the adhesive could be a thermosetting variety or any other type. Moreover, the adhesive may even be eliminated by forming the stem in two parts which are capable of snapping together, one part including a first peripheral flange located interiorly of the bag and the other part including a second peripheral flange located externally of the bag, with a portion of the bag captivated and sealed between the two peripheral flanges. However, regardless of the manner by which the stem is affixed to the bag, the pinch valve itself will still be of the sort disclosed which comprises mating male and female portions which can be quickly closed simply by pinching with the fingers of one hand. It is especially this simplicity of construction of the pinch valve that renders the bag of this invention inexpensive to produce and exceedingly easy to use.

The bags of this invention are capable of use in conjunction with the vacuum sealing of numerous articles such as food products, matches, tissues, cosmetics, pills, small items such as nails, bolts and the like which it is desired to store in a moisture-free and dust-free environment, large items such as articles of clothing, etc. The bags may be made any size and of transparent, translucent or opaque plastic. Bags to be used to store food products should be fabricated from a non-toxic plastic. Likewise, for foodstuff, the stem and pinch valve unit should be formed of non-toxic plastic. It is important also that the adhesive used in the second embodiment be a non-toxic variety when the bag is to be used for food products. Although the length of the stem and pinch valve unit may vary considerably, a typical length would be one to two inches.

Given the benefit of the foregoing disclosure and accompanying drawings, numerous modifications and variations will become apparent to those skilled in the art. Accordingly, it is not intended that the invention be limited to the precise constructions described and illustrated, but, rather, that it be limited only as defined by the following claims.

I claim:

1. An evacuatable or inflatable thin flexible plastic bag having a permanently closed end and an open end opposite the permanently closed end, a zipper closure having an open and closed position formed of mateable male and female interlockable portions extending across the entire open end for closing the same, a tubular stem protruding outwardly from the bag at a location spaced from the zipper closure, and a pinch valve positioned internally of the tubular stem and formed of mateable male and female interlockable portions each extending one half the inner circumference of the tubular stem, the male and female interlockable portions of the pinch valve being separate and distinct from the male and female interlockable portions of the zipper closure, mating and interlocking with each other only when the pinch valve is in the closed position and spaced from each other when in the open position, and being closable by pinching together with the fingers of one hand.

2. The bag of claim 1 wherein the tubular stem and pinch valve are formed unitarily with the material of the bag.

3. The bag of claim 1 wherein the tubular stem and pinch valve are formed as a distinct unit separately from the material of the bag and are attached to the bag.

4. A stem and pinch valve unit for attachment to a thin flexible plastic bag for adapting the bag for evacuation or inflation, comprising: a tubular stem having at one end a peripheral flange with upper and lower surfaces, and a pinch valve positioned internally of the tubular stem and formed of mateable male and female interlockable portions having an open and closed position each extending one half the inner circumference of the tubular stem, the male and female interlockable portions mating and interlocking with each other only when the pinch valve is in the closed position and spaced from each other when in the open position and being closable by pinching together with the fingers of one hand.

5. The stem and pinch valve unit of claim 4 further including a coating of pressure-sensitive adhesive on the upper surface of the peripheral flange.

6. The stem and pinch valve unit of claim 5 further including a removable protective covering over the pressure-sensitive adhesive.

7. The stem and pinch valve unit of claim 4 wherein the end of the tubular stem opposite the peripheral flange has a pointed tip.

8. The stem and pinch valve unit of claim 4 wherein the lower surface of the peripheral flange has a grove therein which extends from the periphery of the peripheral flange to the tubular stem.

9. An evacuatable or inflatable thin flexible plastic bag having a permanently closed end and an open end opposite the permanently closed end, a zipper closure having an open and closed position formed of mateable male and female interlockable portions extending across the entire open end for closing the same, a tubular stem protruding through the bag and extending outwardly from the bag, said tubular stem having at one end a peripheral flange with upper and lower surfaces, said peripheral flange being located inside the bag with the upper surface of said peripheral flange being secured to the internal surface of the bag, and a pinch valve positioned internally of said tubular stem and formed of mateable male and female interlockable portions each extending one half the inner circumference of said tubular stem, the male and female interlockable portions of the pinch valve mating and interlocking with each other only when the pinch valve is in the closed position and spaced from each other when in the open position and being closable by pinching together with the fingers of one hand.

* * * * *